United States Patent [19]

Sogner

[11] 4,143,489

[45] Mar. 13, 1979

[54] MOULD POLISHING MACHINES

[75] Inventor: Roger Sogner, Mornant, France

[73] Assignee: Societe Nouvelle Industrielle & Commerciale d'Applications Mecaniques-S.O.N.I.C.A.M., France

[21] Appl. No.: 796,173

[22] Filed: May 12, 1977

[30] Foreign Application Priority Data

May 14, 1976 [FR] France ..... 76 15166

[51] Int. Cl.[2] ..... B24B 5/08

[52] U.S. Cl. ..... 51/43; 51/90

[58] Field of Search ..... 51/33 R, 33 W, 34 J, 51/34 D, 34 R, 43, 47, 90

[56] References Cited

U.S. PATENT DOCUMENTS

| | | | |
|---|---|---|---|
| 2,313,287 | 3/1943 | Bailly | 51/34 J |
| 2,521,210 | 9/1950 | Fulmer | 51/43 X |
| 2,534,531 | 12/1950 | Rossmanith | 51/43 |
| 3,022,608 | 2/1962 | Tree | 51/43 |
| 3,121,296 | 2/1964 | Ekstrom | 51/43 X |
| 3,736,703 | 6/1973 | Estabrook | 51/34 D X |
| 4,043,080 | 8/1977 | Maxwell | 51/33 W |

FOREIGN PATENT DOCUMENTS

| | | | |
|---|---|---|---|
| 482364 | 3/1917 | France | 51/43 |
| 324583 | 1/1930 | United Kingdom | 51/43 |

*Primary Examiner*—Gary L. Smith

*Attorney, Agent, or Firm*—DeLio and Montgomery

[57] ABSTRACT

A polishing machine comprises a vertically movable surface on which is mounted a driving motor for rotating a support supporting on an axis of oscillation the gearbox an electric motor associated with an eccentric means urging the said motor to pivot on the axis of oscillation, the output shaft of the motor being provided with a spindle carrying a work tool normally occupying an eccentric position relative to the axis of the support. The machine has application in the polishing of the internal impression of a mould.

4 Claims, 5 Drawing Figures

MOULD POLISHING MACHINES

This invention relates to a machine for polishing the interior surface of a mould.

It has long been known to produce different articles or objects by moulding in disposable or re-usable moulds. In the latter instance, there is frequently used unitary or multi-part moulds and, according to the nature, quality or eventual use of the article or object to be produced it is often necessary to polish the internal surface defining the impression in which must be confined the raw material of the article or object.

The first method of effecting this polishing has been manual. If the results obtained were acceptable, indeed very satisfactory, it is certain that a high output would not be reached. In order to reduce the cost of this particular operation, and also to reduce significantly the physical labour necessary by such a manual operation, machines capable of effecting polishing of one or more of the internal surfaces of the cavity of a mould have been envisaged. Additionally, where such attempts have been made in the first place, for moulds comprising a cavity defined by a surface of revolution, one encounters, with known machines, the problem of diameter variation or variation of the cross-section of these cavities and to resolve this problem, machines have been provided comprising one or more complicated work heads, indeed complex, which, as is well known, do not have the normal reliability required.

An object of the invention is to resolve this problem by proposing a novel machine capable of ensuring in a simple and non-laborious manner the polishing of the internal surface of revolution of a mould of any convenient material according to an operating cycle not necessitating intervention of a skilled person.

A further object of the invention is besides particularly conceived in a simple and very robust form so as to be able to be operated wherever the production of different articles or objects is effected by moulding raw material in a mould of any convenient material.

According to the invention the machine for polishing the interior surface of a mould is characterised in that it comprises a base supporting a vertically movable horizontal surface on which is mounted a driving motor for rotating a support carrying on an axis of oscillation generally horizontal and diametral relative to the support, the gear-box of an electric motor having a vertical axis, and associated with an eccentric means constantly urging the said electric motor by pivoting on the axis of oscillation, the output shaft of the electric motor being provided, in the direction of a table formed by the base, with a spindle carrying a tool which is thus subjected, when the machine is in operation, to a rotational movement about its own axis, a planetary displacement, and also a vertical displacement.

The present invention will now be described by way of example with reference to the accompanying drawings in which.

Figure 1:
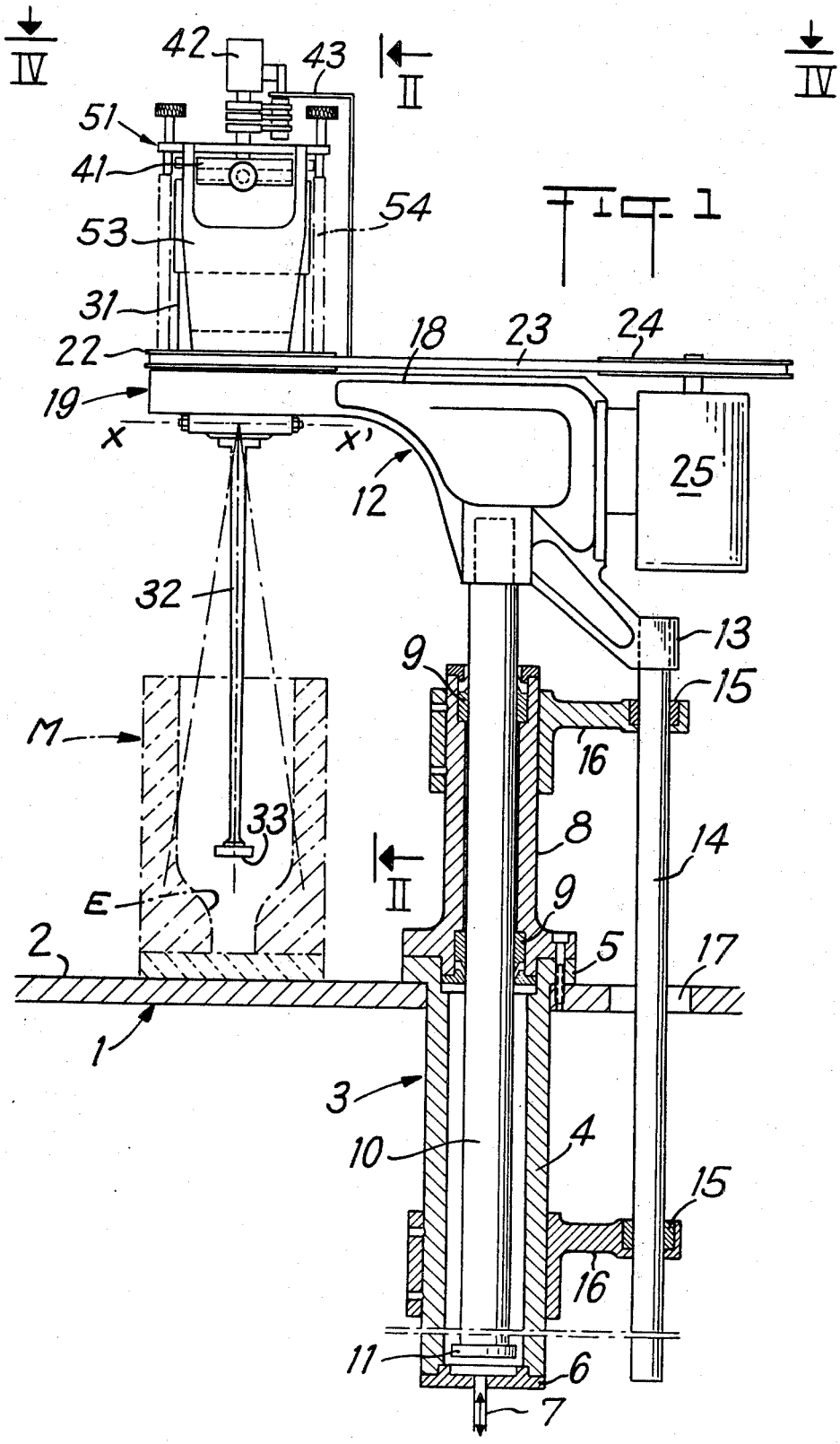
FIG. 1 is side view in partial cross-section of a machine according to the invention.

FIG. 1 shows that the machine according to the invention comprises a base 1 which on its upper surface 2 supports a vertical column 3. The column 3 comprises a hydraulic jack which is fixed by an upper collar 5 onto the upper surface 2 which it traverses. The jack 4 is closed at its base by a cover 6 in which there is a passage 7 to provide for the supply and return of the hydraulic fluid.

The collar 5 of the jack 4 supports a shaft 8 provided in its interior with two guide rings 9 to co-operate slidingly and in fluid-tight engagement with piston rod 10 formed as rod of a hydraulic jack. The tip of the piston rod 10, which is located permanently within the body of the jack 4, is provided with a stop 11 to limit the maximum axial travel and co-operate with the cover 6 or the lower of the guide rings 9. The upper tip of the piston rod 10 carries a support 12 in the form of a swan collar whose base is extended to include a socket 13 for a slide rod 14 constituted by a cylindrical rod extending parallel with the piston rod 10. The slide rod 14 is permanently engaged through guide rings 15 carried by two guides 16 which are adjustably fixed respectively on the shaft 8 and on the jack body 4. In the present case, the guides 16 are disposed above and below the surface 2 which in provided with a hole 17 for the free passage of the slide rod 14.

Figure 3:
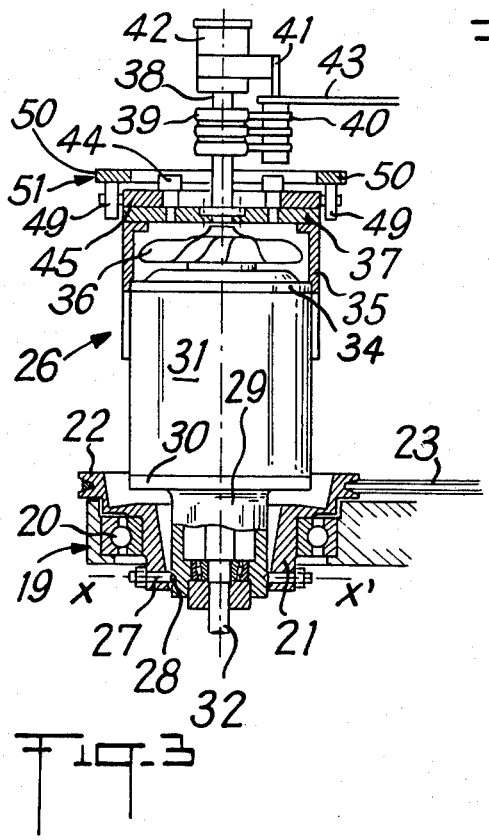
FIG. 3 is fragmentary view in partial cross-section on the line III—III in FIG. 2.
Figure 4:
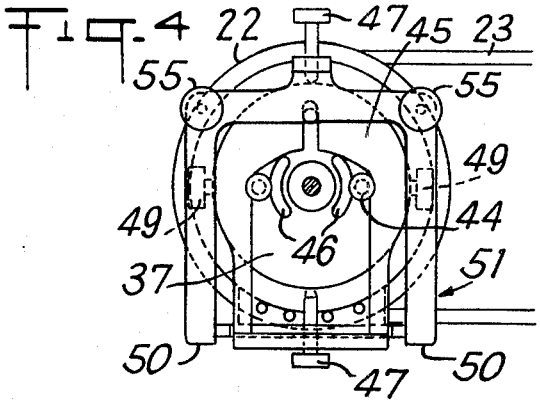
FIG. 4 is a plan view on the line IV—IV of FIG. 1.

The support 12 is shaped in its upper part, opposing the guide 13, to form a flat surface 18 which provides, relative to the axis of the column 3, a cylindrical support 19 for a ball bearing assembly 20. The bearing 20 ensures, as shown in FIG. 3, the support and centering of a tubular hub 21 of a V-pulley 22 with a trapeziform groove and connected by a belt 23 to a drive pulley 24 keyed to the output shaft of an electric motor 25 fixed on the support 12.

The hub 21 of the pulley 22 is intended to ensure the support of a work head 26 mounted in order to have a degree of freedom in relation to the said hub 21. In this example, the play between the hub 21 and the head 26 is defined along an axis of oscillation X-X' in a direction generally parallel to the surface 2 and consequently perpendicular to the column 3. The axis X-X' is delineated by two trunions 27 mounted diametrically opposing each other in the hub 21 in order to penetrate into frustoconical depressions 28 located opposing each other on the same horizontal diameter in the exterior peripheral surface of a nose 29 formed on the lower end 30 of an electric motor 31 disposed along a vertical axis. As shown in the drawings, the end 30 is also engaged and centrally disposed in a ring defined by the pulley 22 in relation to which, the said motor can, in consequence, oscillate in the direction of arrow f1 (FIG. 2) from one side to the other of a vertical plane P passing through the axis of oscillation X-X'. FIG. 3 shows, moreover, the trunions 27, delineating the axis of oscillation X-X' are mounted in the hub 21 so as to be radially controllable in a fashion to render possible the control of the relative play between the motor 31 and the pulley 22 as well as the centering of the said motor in relation to the axis of the pulley.

The output shaft of the electric motor 31 is extended beyond the nose 29 by a spindle 32 whose lower portion, disposed above the surface 2, can be provided with an immovable polishing head 33.

The upper casing surface 34 of the electric motor 31 is associated with a sleeve 35 housing a cooling fan 36 mounted on the tip of the motor shaft opposing the spindle 32. The sleeve 35 is, however, intended to permit the mounting of a rigid end plate 37 delineating at its centre a support in which is fixed an upper spindle 38 independent from the axis of the motor 31 with which it is coaxial. The upper spindle 38 is provided with a commutator 39 of several strips, for example three, which is in electric connection with conductors (not shown) leading to the electric motor 31. The commutator 39 co-operates with brushes 40 which are adapted on a support 41 carried by a support 42 mounted on the upper tip of the spindle 38. The support 41 is moreover associated with a fork 43 mounted firmly on the surface 18, in such a way as to immobilise the support 41 in a fixed predetermined angular position.

The upper end plate 37 ensures the support and guiding, by the intermediary of members 44, of a horse-shoe shaped eccentric plate 45 fashioned always to reveal port holes 46 in the plate 37 in order to allow the supply of air to the fan 36. The members 44 are disposed relatively to determine a fixed angular position of the eccentric plate 45 in relation to the plate 37 and also to permit a diametrical displacement of the said plate in relation to the plate 37 in a direction f2 perpendicular to the axis of oscillation X-X', as shown particularly in FIG. 2. The control of the position of the eccentric plate 45 in relation to the plate 37 is effected via two screws 47 mounted diametrically opposed on lateral extensions 48 of the plate 45 so as to be able to be supported on the peripheral rim of the plate 37. The plate 45 is provided with two diametrically opposed wheels 49, along an axis perpendicular to the axis of the control screws 47. The wheels 49 are intended to roll on the lower faces of parallel arms 50 of a stirrup 51 which is mounted on an axis of oscillation 52 on a plate 53 fixed to the pulley 22 in a known manner, exterior to the motor 31, parallel to the axis of the latter and, more particularly, in plane P as is well shown in FIG. 2. The arms 50 of the stirrup 51 are maintained in permanent rolling contact with the wheels 49 via at least one and preferably two traction springs interposed between the free ends of the arms 50 and the pulley 22. Each traction spring 54 is associated with means to control their tension, and for example, with screws 55 which are mounted on the tips of the arms 50 of the stirrup 51.

Figure 2:
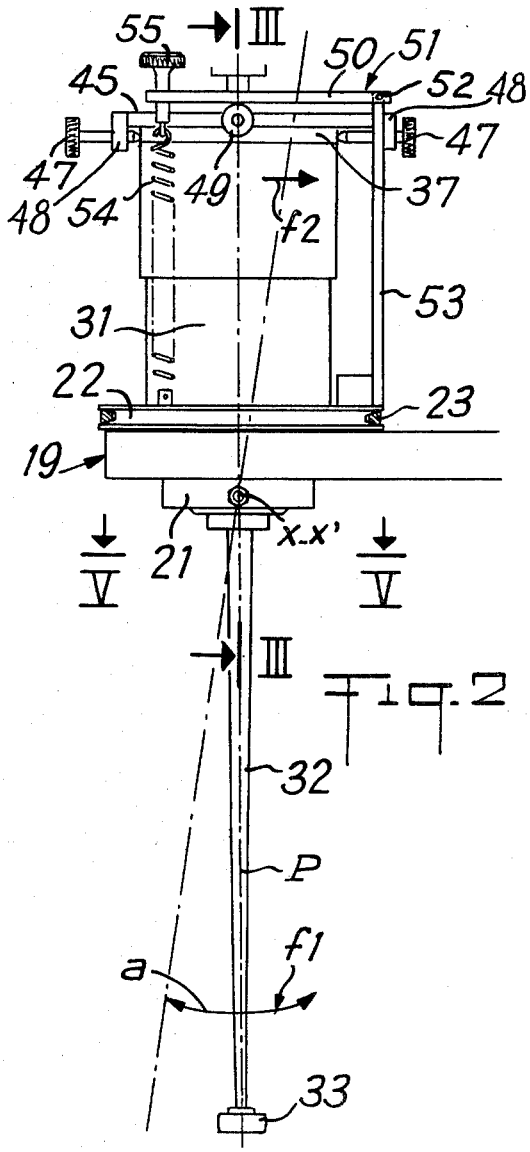
FIG. 2 is a view in partial cross-section along the line II—II in FIG. 1.

In use, the electric motor 31 is mounted and supported, as stated, by the pulley 22 by means of the screws 27 which define, in so far as there is a connection between these two members, the axis of oscillation X-X'. As a result the electric motor is capable of oscillating in the direction of the arrow f1 from one side to the other of plane P in relation to the pulley 22. The general mounting of the plate 53 is equally to render the stirrup fast in rotation with the pulley 22, in order that the said stirrup occupies a fixed angular orientation in relation to the electric motor 31 and a general direction parallel to the necessary sliding of the eccentric plate 45. The control of the transverse position of this latter is effected to cause a movement of the axis of the wheels 49 in relation to the plane P, as shown in FIG. 2, so that the action of the springs 54 acting on the arms 50 of the stirrup 51, tends to cause the displacement of the wheels 49 into the direction f2 and, as a result, to create a movement in the same direction of the motor assembly and the spindle along the axis of oscillation X-X', more particularly in the direction a of the arrow f1. As a result, as shown in dot-dashed lines in FIG. 2, the motor 31 and the spindle 32 occupy, in a resting state, an inclined position in which the polishing head 33 is situated outside of a geometrical axis passing through the support 19 and parallel to the column 3 or in other words to plane P.

Figure 5:
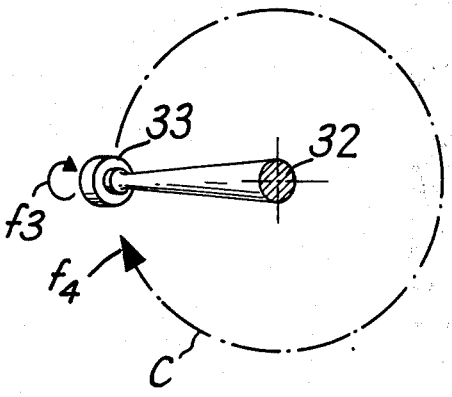
FIG. 5 is a cross-sectional view on the line V—V of FIG. 2 showing, to a greater scale, a working principle of the machine according to the invention.

During operation of the motor 31, the spindle 32 is rotated, for example in the direction of arrow f3 (FIG. 5), so that the polishing head 33 is turned about its own axis. On the contrary, when the motor 25 is also operated, the master pulley 24 causes, via the belt 23, the slave pulley 22 to rotate the assembly of the head 26, for example, in the direction of the arrow f4 (FIG. 5). Consequently, the polishing wheel 33 then undergoes a planetary movement along the circumference C, being animated simultaneously with rotation about its own axis, for example in the direction of arrow f3, or if necessary in a direction which could be considered opposite in relation to that of the arrow f4. The trajectory of the planetary rotation C of the polishing wheel 33 is, as is known, defined by the position of the head assembly 26 relative to the axis of oscillation X-X' as a function of the initial control of the eccentric plate 45 and this position is maintained fixed so that the rotation speed of the slave pulley 22 produces a centrifugal force as great as that exerted on it, from one side to the other of the axis of oscillation X-X', on the spindle 32 and on the head 26. Consequently, if in the resting state, the spindle 32 is introduced into the interior of a mould M fixed to the surface 2 so as to dispose the polishing wheel 33 into the cavity defined by the interior impression E of revolution of which the greatest cross-section or greatest diameter is less than the diameter of the planetary revolution C of the polishing wheel 33 which, when the machine is in use, will consequently be brought to bear against the peripheral surface of the impression E with as much force as the springs 54 have been previously loaded and so that the centrifugal force created will be more significant. Consequently, the planetary movement of the polishing wheel 33 and its simultaneous rotation about its own axis causes working on the part of the surface of revolution of the impression E corresponding to the horizontal plane containing the polishing wheel 33 and depending on the quality of the latter will progressively polish this part of the surface of the impression.

The commissioning of the machine is then completed by the controlled feed of hydraulic liquid to the jack 3 so as to control in a sequential programme vertical reciprocation of the rod or piston rod 10 which entrains during its displacement the support 12 and head assembly 26. The polishing head 33 is consequently caused by the progressive displacement along its work plane, to work over the whole surface of revolution of the impression E, which surface of revolution defines a constant or variable section. Indeed, as indicated above the polishing head 33 is maintained applied against the surface of revolution of the impression E by the action of the springs 54 and centrifugal force so that if the impression E presents variations in a local section of revolution, a greater sectioned segment will have the effect of increasing the angle of oscillation on the axis X-X' while, on the contrary, a reduction in section will have the effect of urging the polishing head 33 in the direction of plane P by reducing the angle of oscillation of the head 26. It is to be noted in the course of this particular functioning phase that the wheels 49 will have been caused to ride up the arms 50 of the stirrup 51 against the action of the springs 54 which oppose a resistance which increases as the angle of oscillation about axis X-X' reduces. The springs 54 thus constitute pressure means applied to the polishing head in support of, or in replacement for, the reduction of the centrifugal force resulting from the decrease of the radius of trajectory of circle C. Consequently, during a complete operational cycle including a progressive elevation followed by a progressive subsequent descent of the piston rod 10, the polishing head 33 is caused to effect a working action on the whole surface of revolution of the impression E which is thus subjected to a progressive polishing by the vertical reciprocation of the head 26 whereof the working element is itself subjected to a planetary rotation of variable diameter as well as rotation about its own axis.

While not shown, it will be manifest that the source of hydraulic energy is associated with elements controlling exhaust or feeding of cylinder 4 such that it is possible to obtain rapid or non-rapid reciprocatory motion as a function of the state of polishing to be obtained, the nature of the polishing head 33 used, as well as the material forming the mould M. The cycle of operation includes a programme for displacing the slide 14.

While not provided, it may be advantageous to associate the reversing means with means determining an alternative variable vertical path for the piston rod so as to avoid the formation of edges between parts of the surface of revolution of the impression E being subjected to working by the polishing head 33 and those parts located at the extreme upper and lower positions of the working plane of the polishing head 33.

The invention is not limited by the described embodiment and modifications may be effected within its scope.

What is claimed is:

1. A machine for polishing the internal surface of a mould comprising a base, a horizontally disposed first support above said base, means for moving said support vertically relative to said base, a first motor mounted on said first support, a second support rotatably carried by said first support, said first motor being adapted to rotate said second support, a second electric motor having a vertical axis and being carried by said second support on an axis of oscillation generally horizontal and diametral relative to the second support, said second electric motor having a downwardly directed output shaft provided with a spindle carrying a tool, eccentric means carried by the first support and comprising at least one spring carried by said second support and acting upon said second electric motor to constantly urge said second electric motor to pivot on said axis of oscillation and to cause the tool to be biased and thereby to follow the contour of the internal surface of a mould and to be subjected, when the machine is in operation, to a rotational movement about its own axis, a planetary displacement and a vertical displacement.

2. A machine according to claim 1 in which the means for moving the first support comprises a vertical column forming a jack having a fixed part and a movable part, the fixed part being mounted on the bore and provided with vertically aligned spaced guides, the movable part carrying the first support and being provided with a rod vertically slidable in said guides, the fixed part of the jack being further provided with a connection to the means for effecting the reciprocation of the movable part.

3. A machine according to claim 1 wherein the second support is constituted by a surface of revolution with a generally vertical axis, the tool carried by the spindle including a polishing head and the movement of the second support being adapted to place the polishing head in an eccentric position relative to the vertical axis of the support.

4. A machine for polishing the internal surface of a mould comprising a base, a horizontally disposed first support above said base, means for moving said support vertically relative to said base, a first motor mounted on said first support, a second support rotatably carried by said first support, said first motor being adapted to rotate said second support, a second electric motor having a vertical axis and being carried by said second support on an axis of oscillation generally horizontal and diametral relative to the second support, eccentric means carried by the first support and adapted to constantly urge said second electric motor to pivot on said axis of oscillation, said second electric motor having a downwardly directed output shaft and said shaft being provided with a spindle carrying a tool which is subjected, when the machine is in operation, to a rotational movement about its own axis, a planetary displacement and a vertical displacement, the means whereby the second electric motor is carried by the second support including a plate perpendicular to the common axis of said second motor and second support, two wheels disposed on the plate parallel to the axis of oscillation and a movable stirrup carried by the support, the plate being connected to the second motor by control means along a diameter perpendicular to the common axis of said two wheels, and a return means being associated with the stirrup and adapted to act on the arms of the stirrup to urge, by means of the wheel, the pivoting of the electric motor on the axis of oscillation.

* * * * *